United States Patent [19]

Sherman et al.

[11] Patent Number: 4,941,236

[45] Date of Patent: Jul. 17, 1990

[54] MAGNETIC CLASP FOR WRISTWATCH STRAP

[75] Inventors: Norman Sherman, Woodbury; Victor Shiff, Waterbury, both of Conn.

[73] Assignee: Timex Corporation, Waterbury, Conn.

[21] Appl. No.: 375,990

[22] Filed: Jul. 6, 1989

[51] Int. Cl.[5] ..... A44B 21/00; A44C 5/18

[52] U.S. Cl. ..... 24/303; 24/71 J; 24/265 WS

[58] Field of Search ..... 24/303, 49 M, 265 WS, 24/71 J, 688; 292/251.5

[56] References Cited

U.S. PATENT DOCUMENTS

| | | | |
|---|---|---|---|
| 1,591,295 | 7/1926 | Donaldson | 24/265 WS |
| 2,499,102 | 2/1950 | Levine | 24/71 J |
| 2,615,227 | 10/1952 | Hornik | 24/230 |
| 2,648,884 | 8/1953 | Loofboro | 24/201 |
| 2,959,832 | 11/1960 | Baermann | 24/303 |
| 3,589,341 | 6/1971 | Krebs | 24/303 |
| 3,747,171 | 7/1973 | Montague, Jr. | 24/265 WS |
| 4,197,618 | 4/1980 | Bourguignon | 24/303 |
| 4,255,837 | 3/1981 | Holtz | 24/243 R |
| 4,615,185 | 10/1986 | Bollinger | 63/5 R |
| 4,620,725 | 11/1986 | Maehashi | 281/45 |
| 4,760,714 | 8/1988 | Mock | 63/3 |

FOREIGN PATENT DOCUMENTS

| | | | |
|---|---|---|---|
| 1155824 | 10/1963 | Fed. Rep. of Germany | 24/303 |
| 074871 | 1/1961 | France | 24/303 |

*Primary Examiner*—Victor N. Sakran
*Attorney, Agent, or Firm*—William C. Crutcher

[57] ABSTRACT

A strap for holding a wristwatch has a pair of separable flexible strap ends adapted to curve around the wrist and to overlap one another to provide an overlapped section. At least one strap end of thermoplastic material has particles of permanently magnetizable material embedded in the thermoplastic material and magnetized to provide rows of alternating magnetic poles. The strap ends have surfaces contacting one another throughout the overlapped section and mutually nesting uniformly spaced interlocking teeth, whereby the magnetized particles provide a holding force resisting separation of the strap ends, while the nested teeth prevent sliding disengagement movement between strap ends.

10 Claims, 3 Drawing Sheets

MAGNETIC CLASP FOR WRISTWATCH STRAP

BACKGROUND OF THE INVENTION

This invention relates generally to straps for wrist instruments, especially wristwatches and relates to improved clasps for attaching the strap ends around the wrist of the wearer. More particularly, the invention relates to an improved wristwatch flexible strap and clasp attachment.

Conventional wristwatches are held on the wrist by leather, metal or plastic straps, bands or bracelets, which may be expanded to go over the wrist or attached around the wrist by attaching strap ends with buckle, clasp or other type of detachable fasteners. This invention relates to wristwatch attachments employing a flexible strap with a pair of strap ends. Typically, the strap ends are connected with a buckle which provides for adjustment of the strap length. The buckle adds to the thickness of the strap, requires a "keeper" to keep the tongue of the strap in place, and sometimes is unsightly or has corners which catch upon sleeves or clothing.

Other types of clasps have been suggested for jewelry, wrist instruments and wristwatches for straps with overlapping strap ends. One design has opposing members coated with fibrous material on one strap end and a layer of material having resilient hook-like members on the other strap end (sold under the registered trademark Velcro ®), such a construction being shown in Montague U.S. Pat. No. 3,747,171, issued July 24, 1973. Another type of bracelet clasp suitable for a strap of flexible thermoplastic material such as polyurethane comprises a sleeve on one strap end with transverse internal teeth and a tongue on the other strap end with complementary nesting teeth, such a construction being shown in Bollinger U.S. Pat. No. 4,615,185, issued Oct. 7, 1986. Such construction requires a sleeve to provide a transverse holding force to maintain the complementary teeth engaged.

Permanent magnets have been suggested in the past for providing a separable clasp for jewelry, animals' collars or the like. For example, Loofboro U.S. Pat. No. 2,648,884, issued Aug. 18, 1953 describes a magnetic clasp of two rigid, two-pole, permanent magnets with an interlocking tongue and groove connection to mechanically lock the sections against relative sliding movement tending to separate the clasp. Another magnetic clasp which is intended to disengage without catching is provided for animal collars as shown in Krebs U.S. Pat. No. 3,589,341, issued June 29, 1971. Still another magnetic clasp for jewelry having two rigid co-acting magnets encased in plastic sheaths discloses a variety of mechanical interlocking protuberances and indentations to prevent sliding separation of the magnetically attracted members.

Holtz U.S. Pat. No. 4,255,837 issued Mar. 17, 1981 and Maehaski U.S. Pat. No. 4,620,725 issued Nov. 4, 1986 each show a pair of sheets of flexible synthetic resin having magnetizable powder therein, permanently magnetized into rows of alternating magnetic polarity providing a holding force between sheets. However, there are no provisions for ridges, protuberances or teeth preventing sliding movement between the magnetically attracted surfaces.

Accordingly, one object of the present invention is to provide an improved flexible strap and clasp attachment for a wristwatch.

Another object of the invention is to provide an improved clasp for a flexible strap which eliminates buckles or other types of protruding members thereby permitting a thinner, more comfortable flexible strap attachment.

Another object is to provide an improved clasp for a wristwatch which is secured, yet easy to engage when desired.

DRAWINGS

The invention, both as to organization and method of practice, together with further objects and advantages thereof, will best be understood with reference to the following description, taken in connection with the accompanying drawings, in which.

Figure 5:
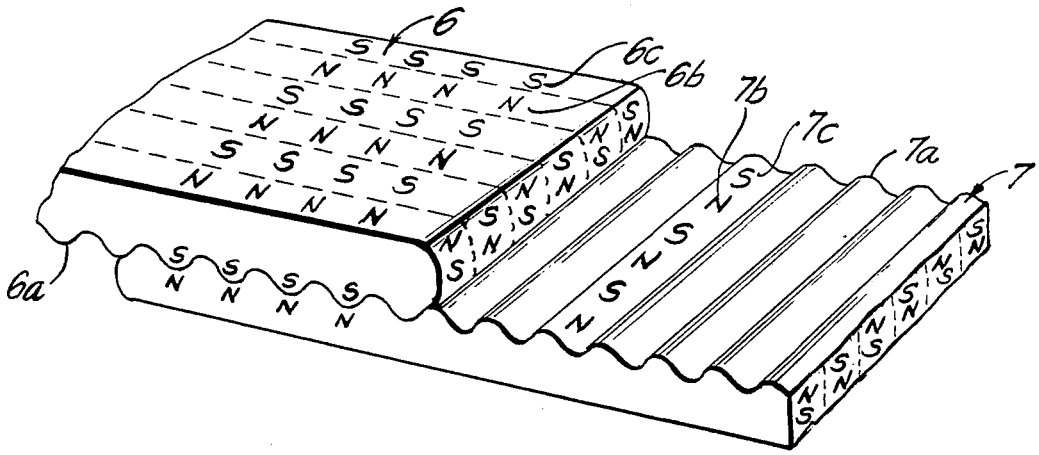
Figure 6:
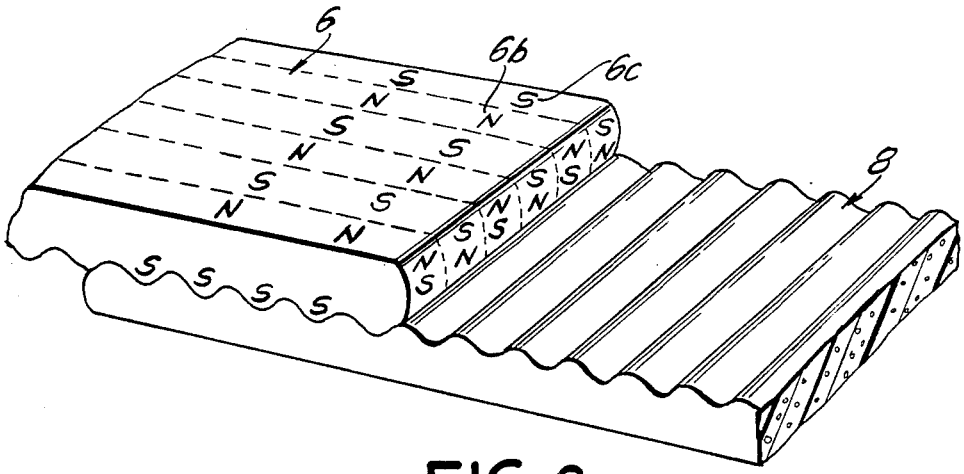
Figure 7:
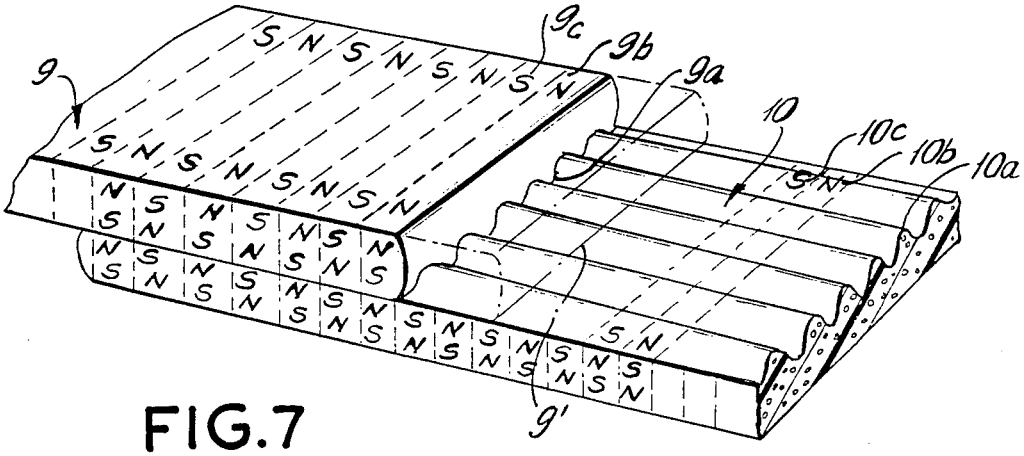
Figure 8:
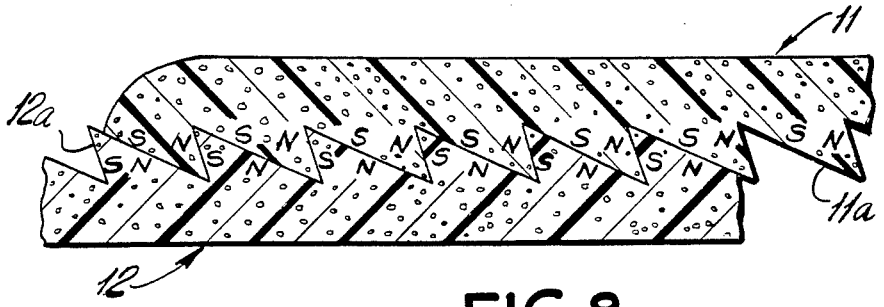
Figure 9:
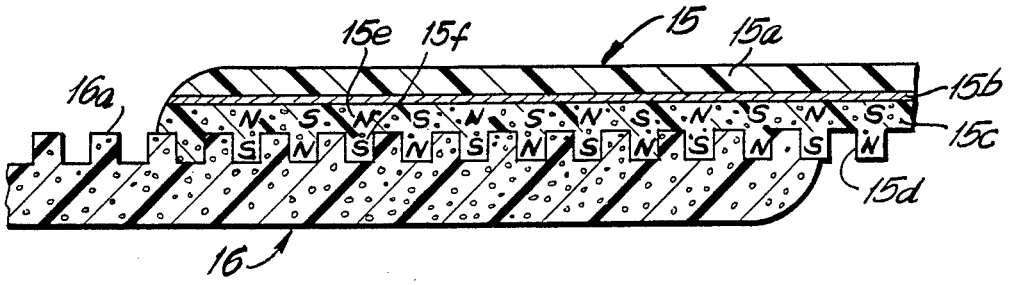
Figure 10:
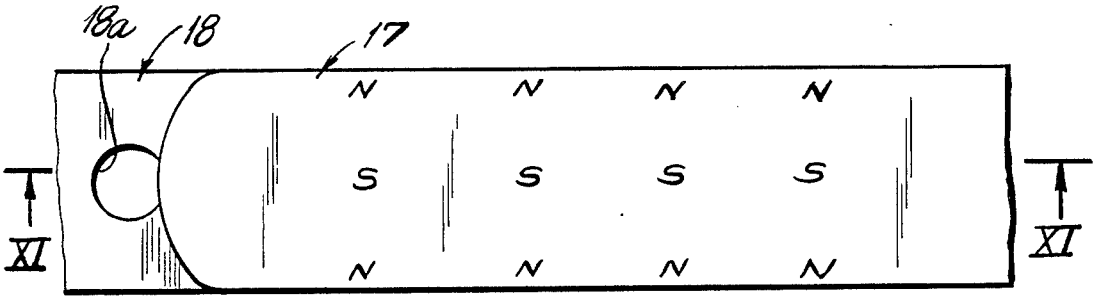
Figure 11:
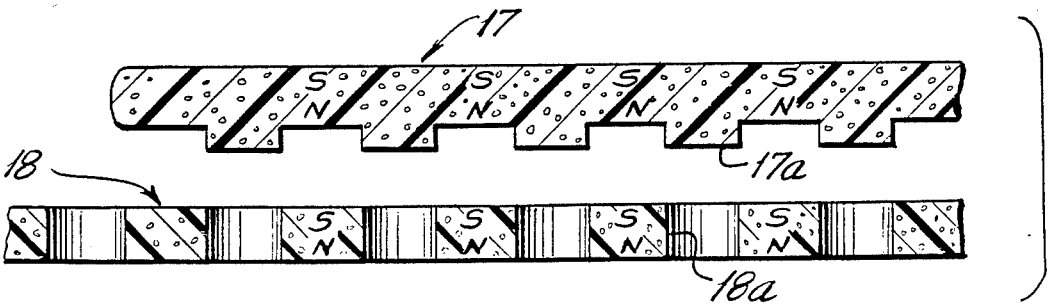

FIGS. 5, 6 and 7 enlarged schematic perspective views of three alternate forms of the improved strap and clasp;

FIG. 8 is an enlarged cross-sectional, elevational view of a strap portion showing an alternate form of the invention;

FIG. 9 is an enlarged cross-sectional elevational view of a strap portion showing yet another form of the invention;

FIG. 10 is an enlarged plan view of another alternate form of the invention showing overlapped strap ends before connection; and FIG. 11 is a cross-sectional, elevational view taken along lines XI—XI of FIG. 10.

SUMMARY OF THE INVENTION

Briefly stated, the invention is practiced by providing a strap having a pair of separable flexible strap ends adapted to curve around the wrist of a wearer and to overlap one another to provide an overlapped section, at least one strap end including at least one ply of thermoplastic material having particles of permanently magnetizable material embedded in the thermoplastic material and magnetized to provide a plurality of rows of alternating magnetic poles, the strap ends having surfaces contacting one another throughout the overlapped section and defining mutually nesting uniformly spaced protuberances and indentations, such as interlocking teeth, whereby the magnetized particles provide a holding force resisting separation of the strap ends, while the nested protuberances and indentations prevent sliding disengaging movement between strap ends. Preferably, the magnetic field is oriented in a longitudinal direction so that when the strap is attached around the wrist, the toroidal path of the magnetic field will reduce stray magnetic flux.

DESCRIPTION OF THE PREFERRED EMBODIMENT

Figure 1:
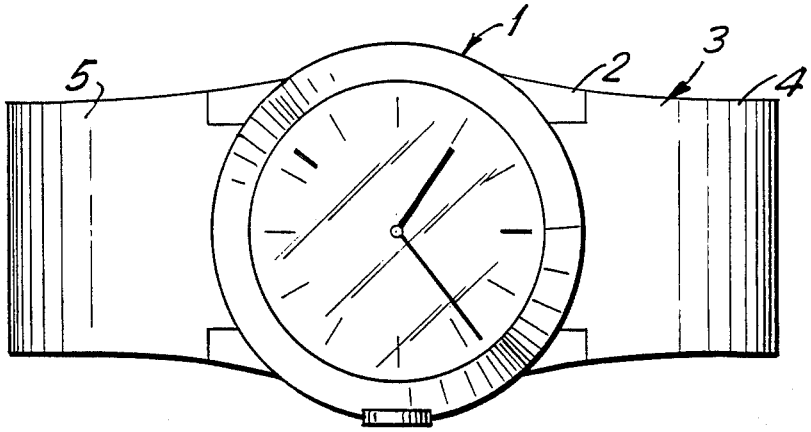
FIG. 1 is a plan view of a wristwatch and strap as worn on the wrist.
Figure 2:
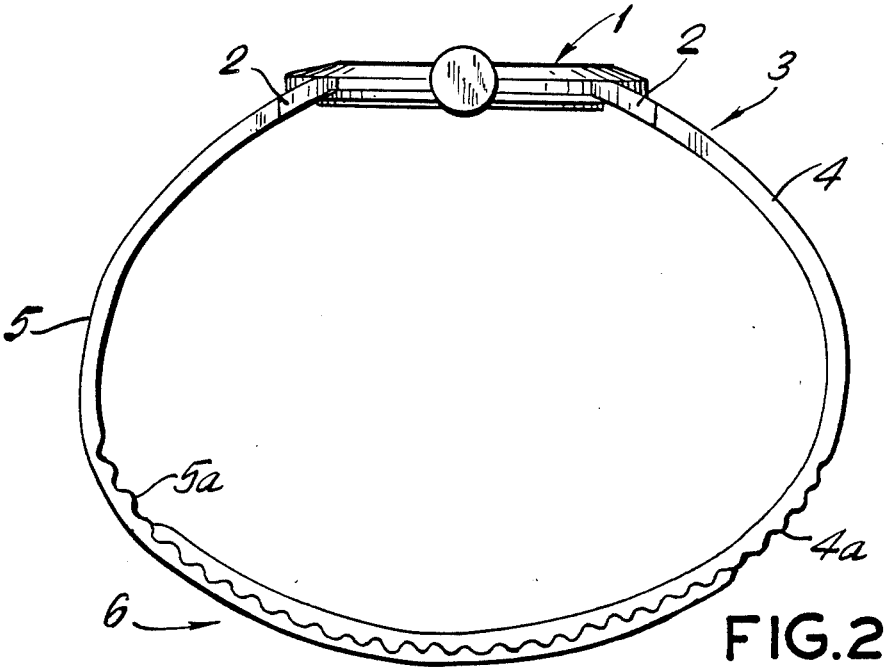
FIG. 2 is an end elevational view of the wristwatch and strap shown in FIG. 1.

Referring now to FIG. 1 of the drawing, a wristwatch shown in FIGS. 1 and 2 of the drawing, includes a watch case 1 with strap attachment lugs 2 and flexible strap 3 of thermoplastic material. The strap is arranged to flex and curve around the wrist of the wearer. The strap 3 consists of two separate strap ends 4, 5, respectively, attached to lugs 2 by conventional spring bars, although the invention also contemplates a single strap member passing through loops on the bezel and terminating in two strap ends. The strap ends 4, 5 mutually cooperate and overlap to provide an overlapped section 6 by means of uniformly spaced transverse ribs 4*a* on strap end 4 facing outward mutually nesting with similar uniformly spaced transverse ribs 5*a* on strap end 5 facing inwardly.

Figure 3:
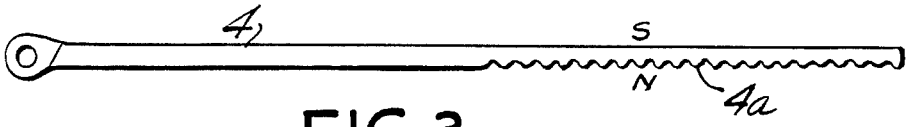
FIG. 3 is a side elevational view of one of the flexible strap ends before it is attached to the wristwatch.
Figure 4:
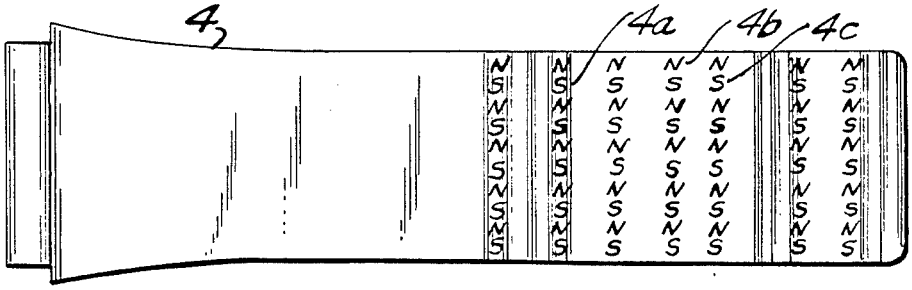
FIG. 4 is a plan view of the strap end shown in FIG. 3.

Referring to FIGS. 3 and 4 of the drawing, one of the strap ends 4 is illustrated before it has been attached to the timepiece. In this case, strap end 4 is shown, but it will be appreciated that strap end 5 is similarly constructed, except that the transverse teeth or ridges are on the outside of the strap and in some arrangements, the type of magnetic material and magnetization pattern will be different as will be explained in detail in connection with the specific examples.

The transverse ridges 4*a* are molded into the surface of the strap and may comprise a simple undulating or sinusoidal type pattern. Alternately, they may be formed in a rectangular or saw tooth configuration or protuberances of various shape and size as will be illustrated in connection with the accompanying descriptions of modified forms of the invention.

In accordance with the invention, the strap material is preferably of flexible thermoplastic material of the type normally used in watchstraps. Examples of such materials are polyurethane, plasticized polyvinyl chloride (PVC), acrylonitrile-butadiene-styrene (ABS) or polypropylene. Embedded within the thermoplastic strap material are finely divided particles of magnetizable material, selected to have substantial magnetic remanance for permanent magnetization and having a high maximum energy product BH where B is flux density expressed in Gauss (Teslas in SI units) and where H is applied magnetic field expressed in Oersteds (Ampere-Turns per centimeter in Si units). The maximum energy product is the largest rectangle which will fit within the hysteresis curve with one corner in the origin and is sometimes expressed in s of $BH \times 10^6$ or Mega-Gauss-Oersted.

Suitable materials are those permanent or "hard" magnetic materials which have substantial residual induction (remanance), suitable permanent magnet materials being alnicos, ferrites or rare-earth magnets. Satisfactory results have been obtained using barium ferrite which has a maximum energy product (BH) of 3.4 Mega Gauss-Oersted. Also suitable are cesium cobalt (16 MGOe) and samarium cobalt (22 MGOe). Much higher energy products are obtainable with special materials such as Neodymium-Iron-Boron having a maximum energy product as high as 35 MGOe. Particles of permanently magnetizable material preferably of particle size between 0.1 and 100 microns 0.0001 mm and 0.1 mm in SI units) are incorporated and mixed within the liquid prepolymers and molded into the strap ends during the normal polymerization process.

Subsequently, the magnetizable particles are permanently magnetized by subjecting the strap ends to a magnetizing field to provide magnetized pole regions of alternating polarity, known as a "multiple pole" structure within at least the terminating end of the strap end. One such pattern, as see in FIG. 4, has alternating longitudinal strips of north poles 4*b* and south poles 4*c*. A number of magnetizing patterns are possible, depending upon the desired application. The north and south poles may be oriented with poles that run longitudinally and parallel along one face of the strap, or they may be arranged with multiple poles that run laterally and parallel along one or both faces of the strap. The preferred arrangement is to provide a pattern of magnetization which provides maximum holding force with respect to the other overlapped strap end, while minimizing external leakage of magnetic flux outside the strap. A variety of arrangements are shown in the remaining FIGS. 5–11 to illustrate the invention.

Referring now to FIG. 5 of the drawing, an enlarged, perspective view is shown of an overlapped section of a strap end 6 and a strap end 7, the curvature around the wrist being omitted from the drawing for purpose of simplification. Strap end 6 defines a plurality of transverse ridges 6*a* and strap end 7 defines a plurality of mating ridges 7*a*. Both strap ends 6 and 7 have embedded therein permanently magnetizable particles of high magnetic remanance, such as the materials described previously. Both strap ends 6 and 7 have been subjected to magnetizing fields to provide rows of alternating north and south poles, such as 6*b*, 6*c*, which are aligned with similar rows of alternating poles 7*b*, 7*c* on strap 7. The flux patterns are perpendicular to the strap ends, and the polarity of poles is selected such that a holding force is developed between strap ends 6, 7 when placed in any of the various longitudinal positions provided by the interlocking teeth or ridges. The magnetic holding force is primarily directed perpendicular to the surface of the strap ends, so as to strongly resist separation. The nested ridges primarily function to resist sliding movement between strap ends.

Referring to FIG. 6 of the drawing, a modification is shown wherein one strap end 6 is identical to the one previously described. The other strap end, designated 8, is formed of flexible thermoplastic material as before, but the particles embedded therein are of soft magnetic material, such as soft ferrites or high purity iron particles. Such particles are magnetizable in the presence of a field, but may not be permanently magnetized. However, they are selected and arranged to provide a path of high magnetic permeability and therefore provide a holding force by the permanent magnets in strap end 6 while reducing external magnetic flux.

Referring to FIG. 7 of the drawing, a strap end 9 and an overlappped strap end 10 are provided with longitudinally extending ribs 9*a* and 10*a*. The permanently magnetizable particles embedded in the flexible thermoplastic material of strap ends 9 and 10 are magnetized in a pattern as shown providing a plurality of transverse rows of alternating magnetic poles 9*b*, 9*c* in strap end 9 and similar alternating rows 10*b*, 10*c* in strap end 10. Contrary to the arrangements shown in FIGS. 5 and 6, the poles alternate in a longitudinal direction and extend transversely across the strap. The interlocking ridges 9*a*, 10*a* in this case provide transverse alignment of the overlapped ends, preventing sidewise or lateral slipping while the magnetic poles serve to provide holding force and longitudinal adjustment. It will be seen that separation and replacement of strap end 9 with respect to strap end 10 will only provide a number of uniformly spaced locations in which the poles are properly aligned to provide a holding force by mutual attraction between north and south poles. One such position longitudinally spaced is indicated by the phantom lines shown at 9'.

FIG. 8 of the drawing illustrates another modification, wherein a strap end 11 and a strap end 12 each define on their contacting surfaces a set of transversely extending slanted teeth 11*a*, 12*a*, respectively. The teeth mutually engage and are slanted away from the respective terminating ends of the strap ends (toward the wrist instrument-not shown) so that they positively prevent longitudinal displacement or sliding disengagement of the strap ends. However, the teeth 12*a*, 11*a* are uniformly spaced so that the strap ends may be separated and re-positioned in another longitudinally displaced position for adjustment of the strap length. Both strap ends 11, 12 contain magnetizable particles dispersed therein, which are magnetized to provide sets of north poles 13 and sets of south poles 14 oriented to produce lines of magnetic flux in a longitudinal direction along the strap, as well as to provide mutually attracting poles along the contacting surfaces of each of the slanted teeth. Directing the magnetic flux in the longitudinal direction through the strap will reduce stray magnetic field which might affect surrounding objects.

FIG. 9 illustrates another modification. A strap end shown generally at 15 comprises three plies in a laminated construction. One ply, 15*a*, is of flexible thermoplastic material without magnetizable particles. An intermediate ply 15*b* is a metallic foil and an inner ply 15*c* is molded of thermoplastic material containing permanently magnetizable particles as before. Uniformly spaced transverse teeth 15*d* are indicated as having a rectangular cross section, but they may be any of the other shapes previously discussed. An overlapped strap end 16 is also provided with nesting transverse teeth 16*a* of rectangular cross section. Strap end 16 is a thermoplastic material having dispersed therein magnetizable particles of soft magnetic iron material of high permeability as previous discussed in connection with FIG. 6. The particles in strap ply 16 are not permanently magnetized, but serve as a path for magnetic flux for permanently magnetized poles such as 15*e*, 15*f* in strap end 15. The foil 15*b* serves as a pole piece to intensify and direct magnetic flux lines from the permanently magnetized particles and also serves as a shield against stray flux.

For a stronger holding force between strap ends, the lower strap end 16 may be constructed exactly like strap end 15 in a multi-ply laminated construction.

Lastly, FIGS. 10 and 11 illustrate a strap end 17 and a strap end 18, both of flexible thermoplastic material and having poles magnetized in a three pole arrangement. Rather than employing identical tooth shapes in both members to resist sliding separation, one of the members defines protuberances 17*a* and the other member 18 defines mating indentations 18*a* which may either be indented only sufficiently to accept protuberances 17*a* or may be holes simply punched all of the way through the strap end. Obviously, the protuberances 17*a* and receiving indentations 18*a* may be of any selected shape and arrangement so long as they are uniformly spaced along the strap ends so that adjustment can be made by separating the strap ends and replacing the strap ends in a longitudinally displaced position. In a more specific sense, therefore, term protruberances includes the transverse rows of teeth previously described and the term indentations includes the valleys between rows of teeth.

The improved clasp is easy to intentionally disengage by pulling one strap end up from the other against the magnetic holding force, which nevertheless is very strong in the case of high energy product magnetic particles. While the watch is being worn, protuberances (or ridges) and identations (valleys) strongly resist unintentional or sliding disengagement of the strap ends, especially where they are shaped as slanted teeth (FIG. 8). The magnetic poles cooperate to hold the strap ends in a nested position, yet are releasable to allow the strap ends to be adjustable by positioning in another nested position.

While there has been described herein what is considered to be the preferred embodiment of the invention, other modifications will occur to those skilled in the art and it is desired to secure in the appended claims all such modifications as fall within the true spirit and scope of the invention.

We claim:

1. An improved strap and clasp assembly comprising a strap having a pair of separable flexible strap ends adapted to curve around the wrist of a wearer and to overlap one another to provide an overlapped section, at least one of said strap ends including at least one ply of flexible thermoplastic material having embedded particles of permanently magnetizable material, said particles being magnetized to provide a first plurality of rows of alternating magnetic poles, the other of said strap ends including embedded particles of magnetizable material, said strap ends having surfaces contacting one another within said overlapped section, said contacting surfaces defining mutually nesting, uniformly spaced, protuberances and indentations, whereby said magnetized particles provide a holding force resisting separation of the strap ends, while said nesting protuberances and identations prevent sliding movement between strap ends.

2. The combination according to claim 1, wherein said other strap end embedded particles are of permanently magnetizable material magnetized to provide a second plurality of rows of alternating magnetic poles.

3. The combination according to claim 1, wherein said other strap end embedded particles are of high permeability soft magnetic material.

4. The combination according to claim 1, wherein said mutually nesting, uniformly spaced protuberances and identations comprise parallel ridges and valleys, respectively.

5. The combination according to claim 4, wherein said ridges and valleys extend transversely across the strap ends and wherein said first plurality of rows of alternating magnetic polarity extend longitudinally of said strap ends.

6. The combination according to claim 4, wherein said ridges and valleys extend longitudinally of said strap ends and wherein said first plurality of rows of alternating magnetic polarity extend transversely across the strap ends.

7. The combination according to claim 1, wherein said protuberances comprise transversely extending teeth slanted away from the respective terminating ends of said strap ends and wherein said teeth of at least said one strap end have their opposite sides permanently magnetized with poles of alternating polarity.

8. The combination according to claim 1, wherein said one strap end includes an additional ply of magnetic foil material arranged to serve as a pole piece.

9. The combination according to claim 1, wherein said thermoplastic material is selected from the group consisting of polyurethane, plasticised polyvinyl chloride, acrylonitrile-butadiene-styrene, polypropylene, or combinations thereof.

10. The combination according to claim 1, wherein said permanently magnetizable particles are selected from the group consisting of alnico, ferrites, rare-earth materials, transition metals or combinations thereof.

* * * * *